US009258861B2

(12) United States Patent
Chu et al.

(10) Patent No.: US 9,258,861 B2
(45) Date of Patent: Feb. 9, 2016

(54) APPARATUS FOR DRIVING MULTI-COLOR LED STRINGS

(71) Applicant: VastView Technology Inc., Hsinchu County (TW)

(72) Inventors: Hung-Chi Chu, Kaohsiung (TW); Yuhren Shen, Tainan (TW)

(73) Assignee: VastView Technology Inc., Hsinchu County (TW)

( * ) Notice: Subject to any disclaimer, the term of this patent is extended or adjusted under 35 U.S.C. 154(b) by 545 days.

(21) Appl. No.: 13/757,747

(22) Filed: Feb. 2, 2013

(65) Prior Publication Data

US 2014/0217909 A1 Aug. 7, 2014

(51) Int. Cl.
*H05B 37/00* (2006.01)
*H05B 33/08* (2006.01)

(52) U.S. Cl.
CPC ..... *H05B 33/0827* (2013.01); *H05B 33/083* (2013.01); *H05B 33/086* (2013.01); *H05B 33/0824* (2013.01)

(58) Field of Classification Search
USPC ..... 315/185 R, 210, 217, 291, 299, 360
See application file for complete search history.

(56) References Cited

U.S. PATENT DOCUMENTS 6,777,891 B2 8/2004 Lys et al.
7,781,979 B2 8/2010 Lys
8,207,691 B2 * 6/2012 Slot ..... H05B 33/0818 315/210
8,264,169 B2 * 9/2012 Shteynberg ..... H05B 33/0815 315/185 R
8,569,976 B2 * 10/2013 Shteynberg ..... H05B 33/0815 315/185 R
9,066,397 B2 * 6/2015 Shteynberg ..... H05B 33/0815
2010/0308739 A1 12/2010 Shteynberg et al.
2011/0085619 A1 4/2011 Reddy et al.
2012/0217887 A1 8/2012 Kang et al.
2012/0306389 A1 * 12/2012 Shteynberg ..... H05B 33/0815 315/186
2014/0159593 A1 * 6/2014 Chu ..... H05B 33/0824 315/191

* cited by examiner

*Primary Examiner* — Thuy Vinh Tran
(74) *Attorney, Agent, or Firm* — Lin & Associates Intellectual Property, Inc.

(57) ABSTRACT

An apparatus comprises red, green and blue LED strings each having a corresponding switching circuit. Each LED string is divided into a plurality of LED segments. The three LED strings are connected in parallel or in series. Each LED string may be connected in series with a respective current source or share a common current source. A controller controls each switching circuit so that the number of LED segments connected in series in the red, green or blue LED string can be respectively controlled according to a color setting signal and the voltage level of an input voltage. A first control method is provided for controlling the apparatus having a constant input voltage and a second control method is provided for controlling the apparatus having a periodically time-varying input voltage.

15 Claims, 14 Drawing Sheets

APPARATUS FOR DRIVING MULTI-COLOR LED STRINGS

BACKGROUND OF THE INVENTION

1. Field of the Invention

The present invention relates generally to light emitting diode (LED) based lighting apparatuses, and more particularly to an apparatus for driving an LED based lighting apparatus having multi-color LED strings.

2. Description of Related Arts

LEDs are semiconductor-based light sources often employed in low-power instrumentation and appliance applications for indication purposes. The application of LEDs in various lighting units has become more and more popular. For example, high brightness LEDs have been widely used for traffic lights, vehicle indicating lights, and braking lights.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting string and a number of LED-based lighting strings may further be connected in series to form a lighting apparatus. For example, U.S. Pat. No. 6,777,891 discloses a plurality of LED-based lighting strings as a computer-controllable light string with each lighting string forming an individually-controllable node of the light string.

The operating voltage required by each lighting string typically is related to the forward voltage of the LEDs in each lighting string, how many LEDs are employed for each of the lighting string and how they are interconnected, and how the respective lighting strings are organized to receive power from a power source. Accordingly, in many applications, some type of voltage conversion device is required in order to provide a generally lower operating voltage to one or more LED-based lighting strings from more commonly available higher power supply voltages. The need of a voltage conversion device reduces the efficiency, costs more and also makes it difficult to miniaturize an LED-based lighting device.

U.S. Pat. No. 7,781,979 provides an apparatus for controlling series-connected LEDs. Two or more LEDs are connected in series. A series current flows through the LEDs when an operating voltage is applied. One or more controllable current paths are connected in parallel with at least an LED for partially diverting the series current around the LED. The apparatus permits the use of operating voltages such as 120V AC or 240V AC without requiring a voltage conversion device.

US Pat. Publication No. 2010/0308739 discloses a plurality of LEDs coupled in series to form a plurality of segments of LEDs and a plurality of switches coupled to the plurality of segments of LEDs to switch a selected segment into or out of a series LED current path in response to a control signal. US Pat. Publication No. 2011/0085619 discloses an LED selection circuit for an LED driver that drives multiple unequal lengths of LED strings to selectively turn the LED strings on and off corresponding to an input AC line voltage. US Pat. Publication No. 2012/0217887 discloses LED lighting systems and control methods capable of providing an average luminance intensity independent from the variation of an AC voltage.

As more and more LED-based lighting strings are used in high brightness lighting equipment, there is a strong need to design methods and apparatus that can drive and connect the LED-based lighting strings intelligently and efficiently to increase the utilization of the LEDs and provide stable and high brightness by using the readily available AC source from a wall power unit.

In principle, it is possible to generate a light of any desirable color if LEDs of red, green and blue colors are assembled together in a lighting apparatus. In order to operate under the readily available AC voltage, a multi-color LED lighting apparatus presents a further challenge in the design of its driving circuit because the number of LEDs in each color and how the LEDs of different colors are connected in series or parallel have to be considered in addition to the variation of the input AC voltage.

There is a strong need in providing an efficient and flexible driving circuit for the multi-color LED lighting apparatus to generate lights of different colors and different brightness under different lighting and color requirements.

SUMMARY OF THE INVENTION

The present invention has been made to provide an apparatus that can efficiently drive multi-color LED strings with the input voltage supply being either a constant voltage or a periodically time-varying voltage. In accordance with the present invention, the apparatus comprises a red LED string, a green LED string and a blue LED string each being divided into a plurality of LED segments and having a corresponding switching circuit controlled by a controller.

In a first preferred embodiment of the apparatus according to the present invention, the red, green and blue LED strings are connected in parallel and each LED string is connected respectively in series with a current source to ground. The controller sends controlling signals to each switching circuit to connect some or all of the LED segments in series or by-pass some or all of the LED segments in each LED string. The number of LED segments to be connected in series in each LED string is determined by a color setting signal and the voltage level of the input voltage.

In a second preferred embodiment of the apparatus according to the present invention, the red, green and blue LED strings are connected in series and only the last LED string is connected in series with a current source to ground. The controller sends controlling signals to each switching circuit to connect some or all of the LED segments in series or by-pass some or all of the LED segments in each LED string. The number of LED segments to be connected in series in each LED string is determined by a color setting signal and the voltage level of the input voltage.

In a third preferred embodiment of the apparatus according to the present invention, the red, green and blue LED strings are connected in parallel and the three LED strings connected through a multiplexing switch to a common current source to ground. The controller sends controlling signals to connect some or all of the LED segments in series or by-pass some or all of the LED segments in each LED string. The controller also sends multiplexing signals to control the multiplexing switch. The number of LED segments to be connected in series in each LED string is determined by a color setting signal and the voltage level of the input voltage.

According to the present invention, the switching circuit can be implemented with four exemplary types. In the first exemplary type, each LED segment is connected in parallel with a switching device. In the second exemplary type, each LED segment is connected in parallel with an LED controlling circuit.

In the third exemplary type, each LED segment has a corresponding switching device that has one end connected to a positive end of the corresponding LED segment and another end connected to the negative end of the last LED segment in the LED string. In the fourth exemplary type, each LED segment has a corresponding LED controlling circuit and each controlling circuit has one end connected to a positive end of the corresponding LED segment and another end connected to the negative end of the last LED segment in the LED string.

The present invention also provides two methods of controlling the apparatus for driving multi-color LED strings. The first method is provided for the apparatus having an input voltage which is a constant voltage. The first method of controlling the apparatus is more applicable to the switching circuit of the first or second exemplary type of the present invention but less suitable for the switching circuit of the third or fourth exemplary type.

The second method of controlling the apparatus for driving multi-color LED strings is provided for an input voltage which is a periodically time-varying voltage. In order to apply the second method to the first, second or third preferred embodiment of the apparatus with the first, second, third or fourth exemplary type of the switching circuit, variations in the circuit of the controller are also provided so that the switching circuits and the associated current sources can be controlled appropriately.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
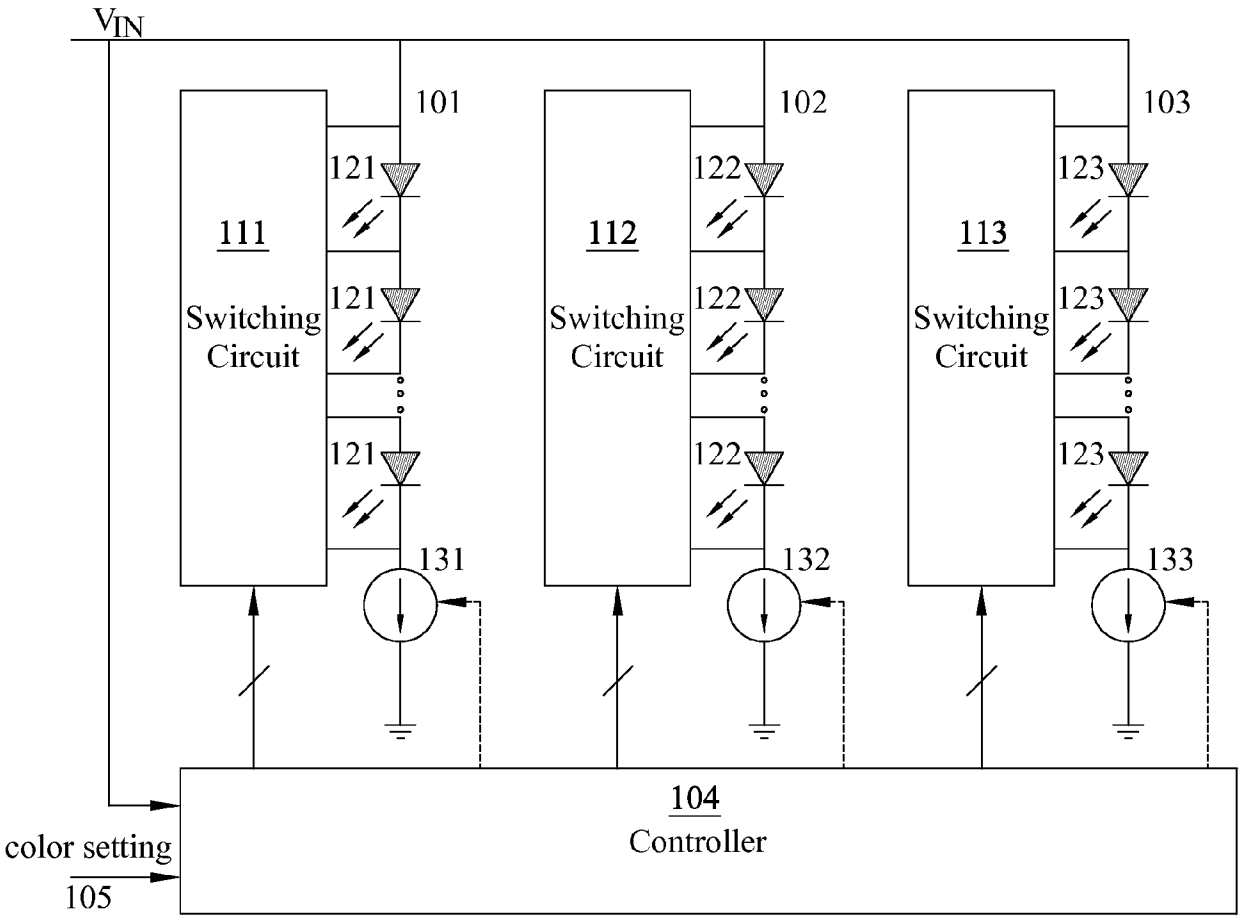
FIG. 1 shows a block diagram of an apparatus for driving multi-color LED strings according to a first preferred embodiment of the present invention.

The accompanying drawings are included to provide a further understanding of the invention, and are incorporated in and constitute a part of this specification. The drawing illustrates embodiments of the invention and, together with the description, serves to explain the principles of the invention.

FIG. 1 shows a block diagram of an apparatus for driving multi-color LED strings according to a first preferred embodiment of the present invention. In the embodiment, the apparatus comprises a red LED string 101, a green LED string 102 and a blue LED string 103 connected in parallel. Each of the red, green and blue LED strings 101, 102 and 103 is controlled by a respective switching circuit 111, 112 and 113.

With reference to FIG. 1, the red LED string 101 comprises a plurality of red LED segments 121 connected in series. Each LED segment 121 further includes a plurality of red LEDs connected between a positive end and a negative end of each LED segment 121. For simplicity, FIG. 1 shows only one red LED in each red LED segment 121.

An input voltage $V_{IN}$ provides power to the red LED string 101. A current source 131 connects the negative end of the last red LED segment 121 to ground. The switching circuit 111 is used to control the total number of red LEDs that are connected in series in the red LED string 101. The switching circuit 111 is controlled by a controller 104. The current source 131 may be a variable current source controlled by the controller 104 or a constant current source.

As can be seen in FIG. 1, in the first preferred embodiment, the LED strings of green, red and blue colors all have similar structure. The green LED string 102 comprises a plurality of green LED segments 122 connected in series with a current source 132, and the blue LED string 103 comprises a plurality of blue LED segments 123 connected in series with a current source 133. However, the number of LED segments in each LED string may be different.

As can also be seen in FIG. 1, each switching circuit 111, 112 and 113 can be controlled by the controller 104 to configure the numbers of LED segments connected in series in the respective red, green and blue LED strings 101, 102 and 103. The controller 104 controls the number of LED segments connected in series in each LED string according to a color setting signal 105 by sending a plurality of controlling signals to the switching circuits. The controller 104 also receives power from the input voltage $V_{IN}$.

Figure 2:
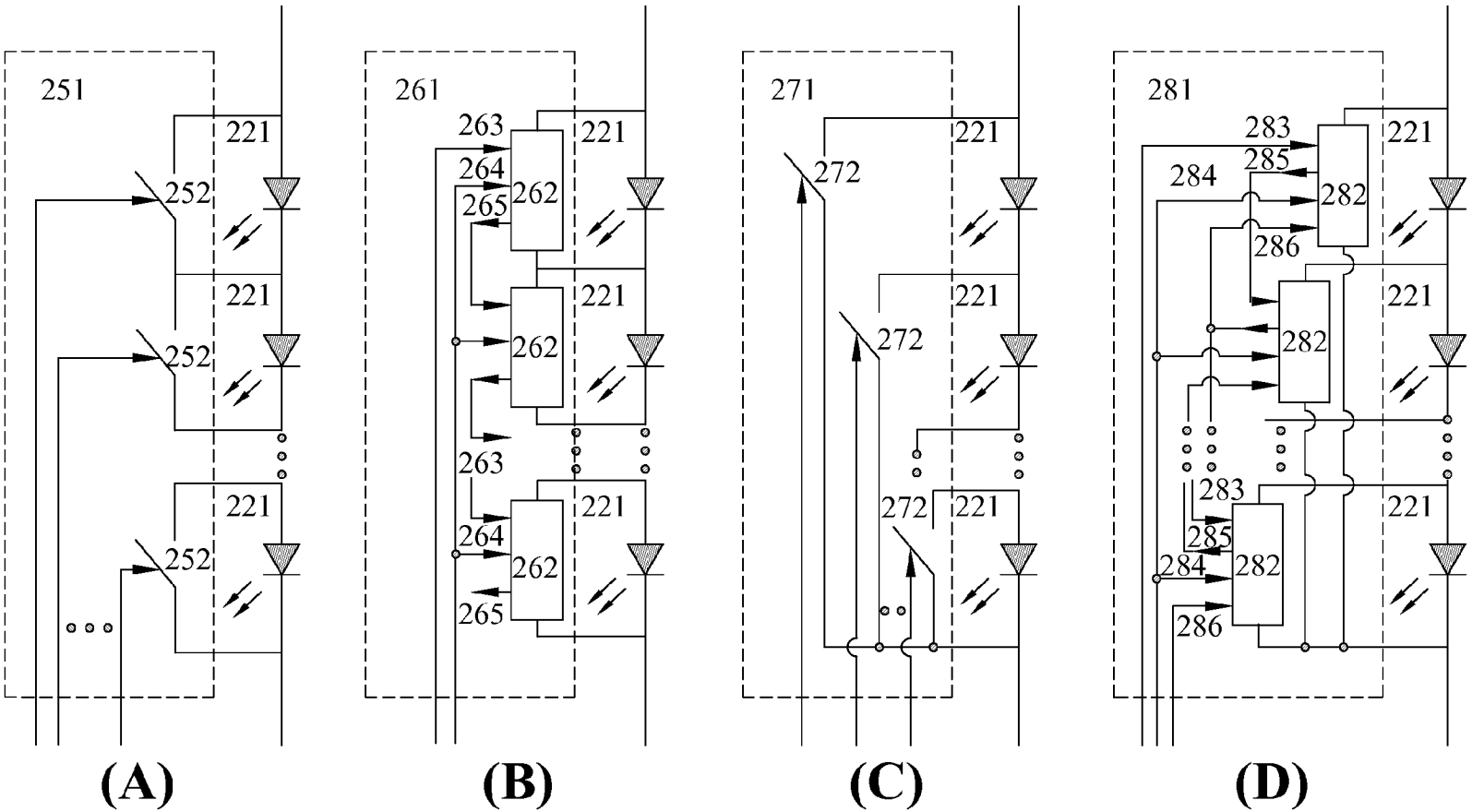
FIGS. 2A-2D show the circuits of four exemplary types of the switching circuit.

According to the present invention, the switching circuits 111, 112 and 113 can be implemented with different types of circuits. FIG. 2 shows four exemplary types. FIG. 2A shows the circuit of a first exemplary type 251 of the switching circuit. It can be seen that in the first exemplary type, each LED segment 221 in the LED string has a corresponding switching device 252 that is connected in parallel with the LED segment 221. Therefore, each LED segment 221 can be independently by-passed by using the controlling signal from the controller 104 of the first exemplary type 251 to control how many LED segments 221 are connected in series in the LED string.

FIG. 2B shows the circuit of a second exemplary type 261 of the switching circuit. As can be seen in FIG. 2B, each LED segment 221 has a corresponding LED controlling circuit 262 connected in parallel. Each LED controlling circuit 262 receives a few common signals 264 from the controller 104 of the second exemplary type 261 and an input propagation signal 263, and sends out an output propagation signal 265 to the next LED controlling circuit 262 as shown in FIG. 2B.

In accordance with the present invention, the LED controlling circuit 262 can be controlled by the controller 104 of the second exemplary type 261 to by-pass the corresponding LED segment 221. The output propagation signal 265 sent by each LED controlling circuit 262 serves as the input propagation signal 263 of its following LED controlling circuit 262. The first (top) LED controlling circuit 262 receives a forward propagation signal from the controller 104 of the second exemplary type 261 as its input propagation signal 263. In some applications, the first LED segment 221 on the top of the LED string may not have a corresponding LED controlling circuit 262 so that at least one LED segment 221 in the LED string is always turned on.

As mentioned before, the controller 104 of the second exemplary type 261 sends a few common signals 264 to each LED controlling circuit 262. The common signals 264 include reset, up/down and sync signals to each LED controlling circuit 262. The reset signal resets all the LED controlling circuits 262 to their initial states. Up/down signal indicates the rising or falling of the input voltage $V_{IN}$. Sync signal is a signal for synchronizing the switching of the LED controlling circuits 262. It should be noted that each LED controlling circuit 262 does not have to be implemented by the same circuit as long as it can provide the controlling function to by-pass the corresponding LED segment 221.

FIG. 2C shows the circuit of a third exemplary type 271 of the switching circuit. As can be seen in FIG. 2C, each LED segment 221 has a corresponding switching device 272. In the first exemplary type 251 shown in FIG. 2A, each switching device 252 is connected in parallel with the corresponding LED segment 221. In the third exemplary type 271, however, each switching device 272 is connected between the positive end of the corresponding LED segment 221 and the negative end of the last LED segment 221 in the LED string.

In other words, in each LED string all the switching devices 272 have a common end connected to the negative end of the LED string. As a result, each LED segment 221 is not independently controllable. For example, if the controller 104 of the third exemplary type 271 turns on the switching device 272 corresponding to the LED segment 221 on the top, all the LED segments in the LED string are by-passed.

FIG. 2D shows the circuit of a fourth exemplary type 281 of the switching circuit. As can be seen in FIG. 2D, each LED segment 221 has a corresponding LED controlling circuit 282. In the second exemplary type 261 shown in FIG. 2B, each LED controlling switch 262 is connected in parallel with the corresponding LED segment 221. In the fourth exemplary type 281, however, the LED controlling circuit 282 is connected between the positive end of the corresponding LED segment 221 and the negative end of the last LED segment 221 in the LED string.

In the forth exemplary type 281 of the present invention, the controller 104 of the fourth exemplary type 281 sends a few common signals 284 to each LED controlling circuit 282. Except for the first and last LED controlling circuits 282 in each LED string, each LED controlling circuit 282 receives a first input propagation signal 283 from the preceding LED controlling circuit 282 and a second input propagation signal 286 from the following LED controlling circuit 282 and sends out an output propagation signal 285 to both the preceding and following LED controlling circuits 282 as shown in FIG. 2D.

As can be seen in FIG. 2D, the first (top) LED controlling circuit 282 receives a forward propagation signal from the controller 104 of the fourth exemplary type 281 as its first input propagation signal 283, and the last (bottom) LED controlling circuit 282 receives a backward propagation signal from the controller 104 of the fourth exemplary type 281 as its second input propagation signal 286. In some applications, the first LED segment 221 on the top of the LED string may not have a corresponding LED controlling circuit 282 so that at least one LED segment 221 in the LED string is always turned on.

Similar to FIG. 2B, the controller 104 of the fourth exemplary type 281 sends a few common signals 284 to each LED controlling circuit 282. The common signals 284 include reset, up/down and sync signals to each LED controlling circuit 282. The reset signal resets all the LED controlling circuits 282 to their initial states. Up/down signal indicates the rising or falling of the input voltage $V_{IN}$. Sync signal is a signal for synchronizing the switching of the LED controlling circuits 282. Each LED controlling circuit 282 in the fourth exemplary type 281 does not have to be implemented by the same circuit as long as it can provide the required functions.

With reference to FIG. 2D, all the LED controlling circuits 282 have a common end connected to the negative end of the LED string. As a result, each LED segment 221 is not independently controllable. For example, if the controller 104 of the fourth exemplary type 281 turns on the LED controlling circuit 282 corresponding to the LED segment 221 on the top, all the LED segments in the LED string are by-passed.

Figure 3:
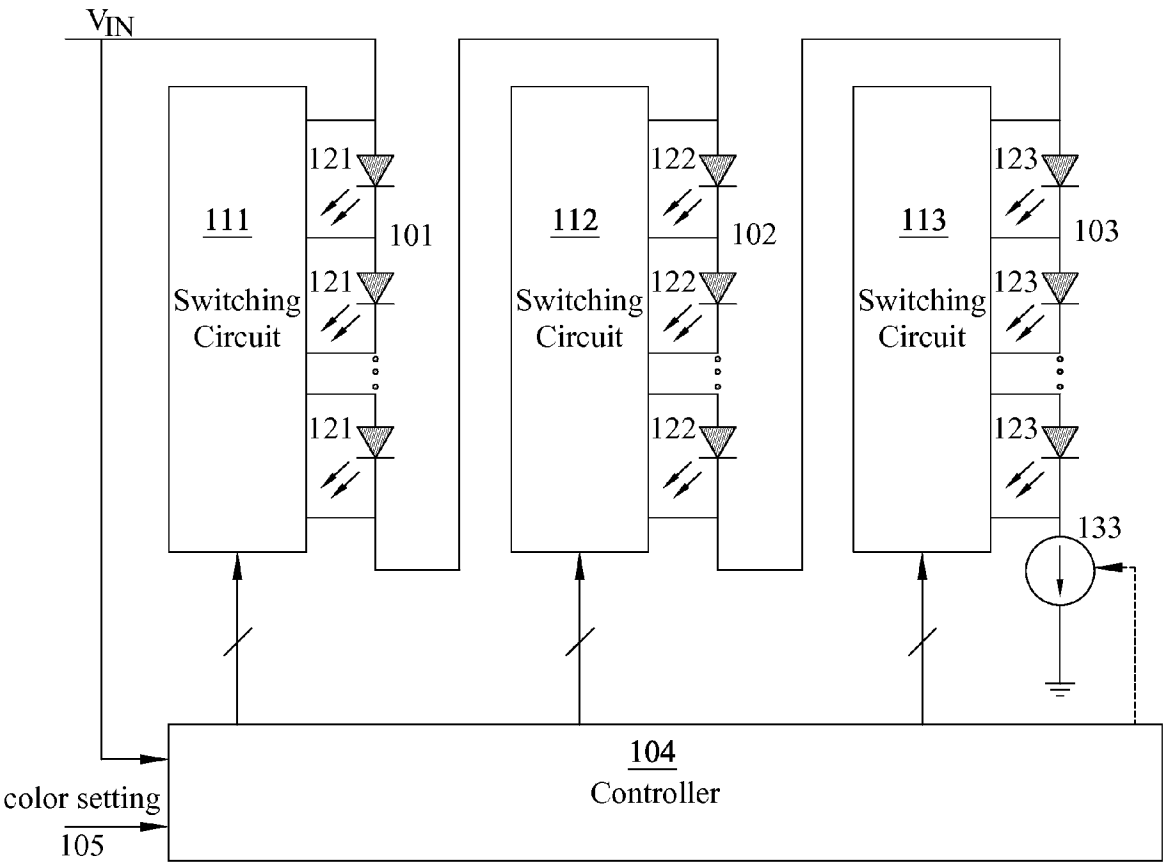
FIG. 3 shows a block diagram of an apparatus for driving multi-color LED strings according to a second preferred embodiment of the present invention.

FIG. 3 shows a block diagram of an apparatus for driving multi-color LED strings according to a second preferred embodiment of the present invention. In the second embodiment, the apparatus comprises a red LED string 101, a green LED string 102 and a blue LED string 103 connected in series. Each of the red, green and blue LED strings 101, 102 and 103 is controlled by a respective switching circuit 111, 112 or 113.

As can be seen in FIG. 3, the negative end of the last red LED segment 121 in the red LED string 101 is connected to the positive end of the first green LED segment 122 in the green LED string 102 and the negative end of the last green LED segment 122 in the green LED string 102 is connected to the positive end of the first blue LED segment 123 in the blue LED string 103. Only the blue LED string 103 is connected in series with a current source 133.

In the second preferred embodiment shown in FIG. 3, each switching circuit 111, 112 and 113 can also be controlled by the controller 104 to control the numbers of LED segments connected in series in the respective red, green and blue LED strings 101, 102 and 103. The controller 104 controls the number of LED segments connected in series in each LED string according to a color setting signal 105 by sending a plurality of controlling signals to the switching circuits. The number of LED segments in each LED string may be different. The controller 104 also receives power from the input voltage $V_{IN}$.

Figure 4:
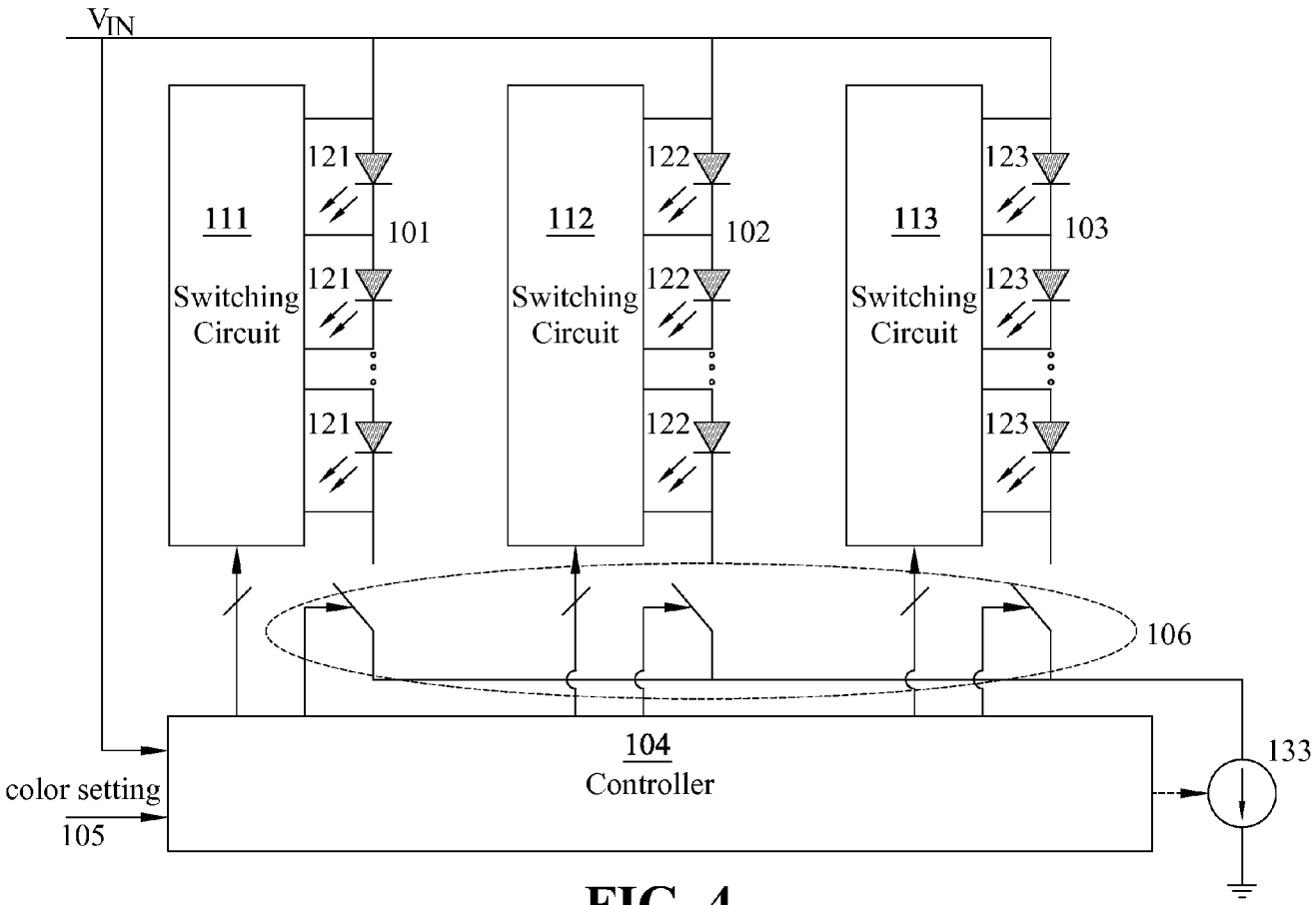
FIG. 4 shows a block diagram of an apparatus for driving multi-color LED strings according to a third preferred embodiment of the present invention.

FIG. 4 shows a block diagram of an apparatus for driving multi-color LED strings according to a third preferred embodiment of the present invention. In the third embodiment, the apparatus comprises a red LED string 101, a green LED string 102 and a blue LED string 103 connected through a multiplexing switch 106 to a common current source 133. Each of the red, green and blue LED strings 101, 102 and 103 is controlled by a respective switching circuit 111, 112 or 113.

As can be seen in FIG. 4, the multiplexing switch 106 is controlled by the controller 104 to connect the red, green and blue LED strings 101, 102 and 103 to the common current source 133. In the third preferred embodiment shown in FIG. 4, each switching circuit 111, 112 and 113 can also be controlled by the controller 104 to control the number of LED segments connected in series in the respective red, green and blue LED strings 101, 102 and 103 according to a color setting signal 105 by sending a plurality of controlling signals to the switching circuits. The main difference between the first and third preferred embodiments is that the common current source 133 is shared by the three LED strings in the third embodiment.

In accordance with the present invention, there are two methods of controlling the apparatus for driving multi-color LED strings. A first method is provided for an input voltage $V_{IN}$ which is a constant voltage. In the first method, the brightness of the LED string in each color is first determined by the color setting signal. The number of LEDs to be connected in series in the LED string of each color is then determined according to the brightness. Finally, the state of the switching circuit corresponding to each LED string is set according to the number of the LEDs to be connected in series.

As an example, it is assumed that there are N LEDs divided into k segments in each of the LED strings, and the number of LEDs in each segment can be designed as $S_1, S_2, \ldots, S_k$ according to the following formulas:

$$S_1 = 1,\ S_n \le \sum_{i=1}^{n-1} S_i + 1 \text{ for } 2 \le n \le k, \text{ and } S_k = N - \sum_{i=1}^{k-1} S_i.$$

Under the condition of a constant current, the apparatus with the first or second exemplary type of the switching circuit according to the present invention can provide $N^3$ different colors based on the above formulas.

It is worth pointing out that the first method of controlling the apparatus described above is more applicable for controlling the switching circuit of the first or second exemplary type of the present invention. If the first method is applied to the third or fourth exemplary type of the switching circuit, each LED string would require N segments to form N different series connections. As a result, the first method is less suitable for the third or fourth exemplary type of the switching circuit.

Figure 5:
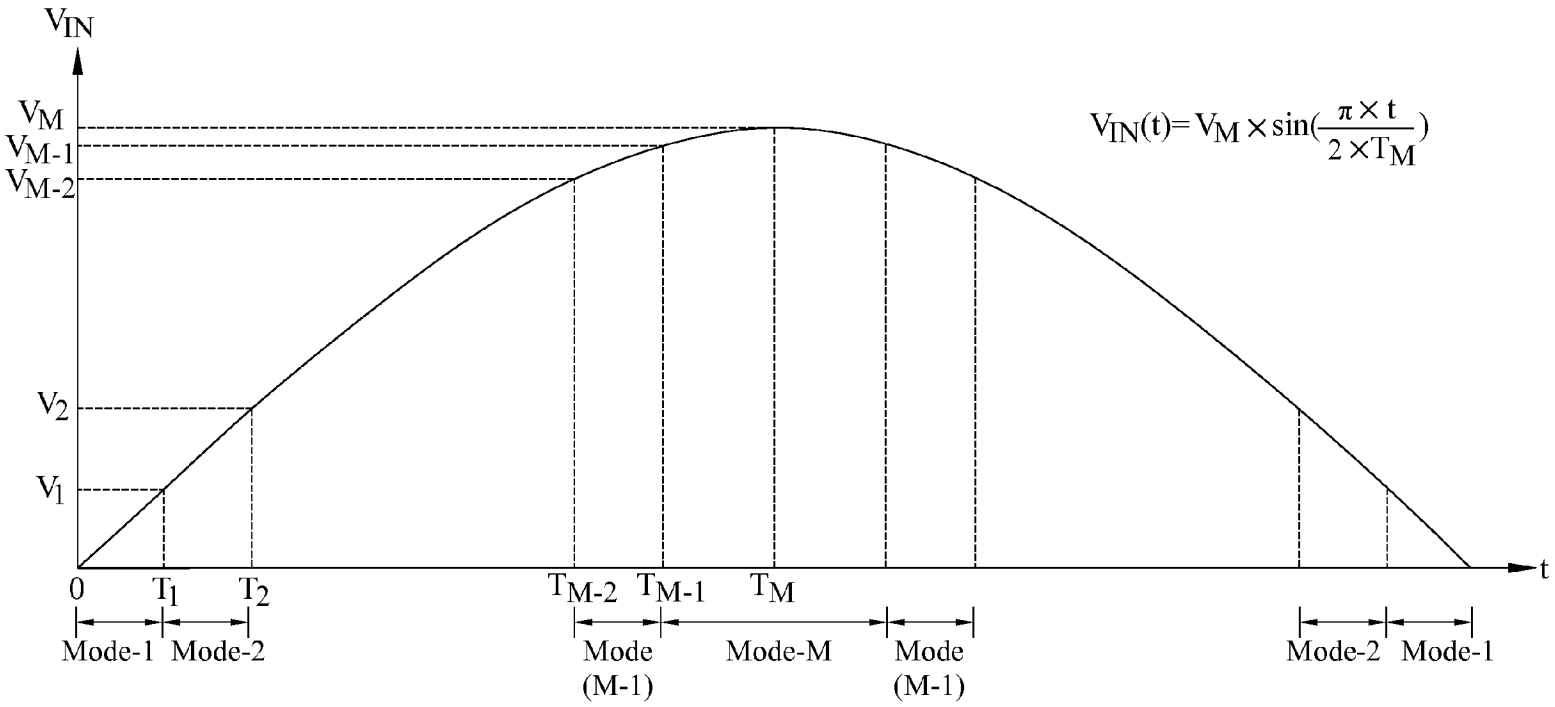
FIG. 5 shows that each LED string of the present invention can be operated in M different modes as the voltage level of the input voltage changes.

According to the present invention, a second method of controlling the apparatus for driving multi-color LED strings is provided for an input voltage $V_{IN}$ which is a periodically time-varying voltage. For example, the input voltage $V_{IN}$ is a rectified AC voltage that can be represented as $V_{IN}(t)=V_M \sin(\pi t/2T_M)$, where $V_M$ is the maximum voltage and $4*T_M$ is the period of the AC cycle. FIG. 5 shows that each LED string of the present invention can be operated in M different modes as the voltage level of the input voltage $V_{IN}$ changes with each mode having a different number of LEDs connected in series.

As shown in FIG. 5, the LED string operates in Mode-i between time $T_{i-1}$ and $T_i$ as the voltage level of the input voltage $V_{IN}$ increases between $V_{i-1}$ and $V_i$. As the rectified AC voltage reaches the maximum level, i.e., $V_M$, the voltage level starts decreasing. The LED string operates in Mode-M while the voltage level is between $V_{M-1}$ and $V_M$, and switches to operate in Mode-i when the voltage drops between $V_{i-1}$ and $V_i$. The brightness of the LED string is proportional to $$\sum_{j=1}^{M} \int_{T_{j-1}}^{T_j} N_j I_j dt,$$

where $N_j$ is the number of LEDs connected in series in the LED string and $I_j$ is the LED current of Mode-j.

If the second method of controlling the apparatus for driving multi-color LED strings is applied to the first preferred embodiment of the invention, the switching circuit changes the number of LEDs connected in series in each LED string according to the input voltage level. In addition, the duration that the current source of each LED string is turned on is controlled to be proportional to the brightness required for the corresponding red, green or blue color.

If the second method of controlling the apparatus for driving multi-color LED strings is applied to the second preferred embodiment of the invention, a table is first computed for the LED strings according to the brightness required for the corresponding red, green and blue colors. The table includes the number of LEDs in each mode based on the voltage level at the time that each LED string operates. The controller controls the switching circuit to connect the LEDs in series in each LED string according to the table based on the voltage level.

If the second method of controlling the apparatus for driving multi-color LED strings is applied to the third preferred embodiment of the invention, the switching circuit changes the number of LEDs connected in series in each LED string according to the input voltage level. In addition, the duration that each LED string is connected to the common current source 133 is controlled to be proportional to the brightness required for the corresponding red, green or blue color by properly controlling the multiplexing switch 106.

Figure 6:
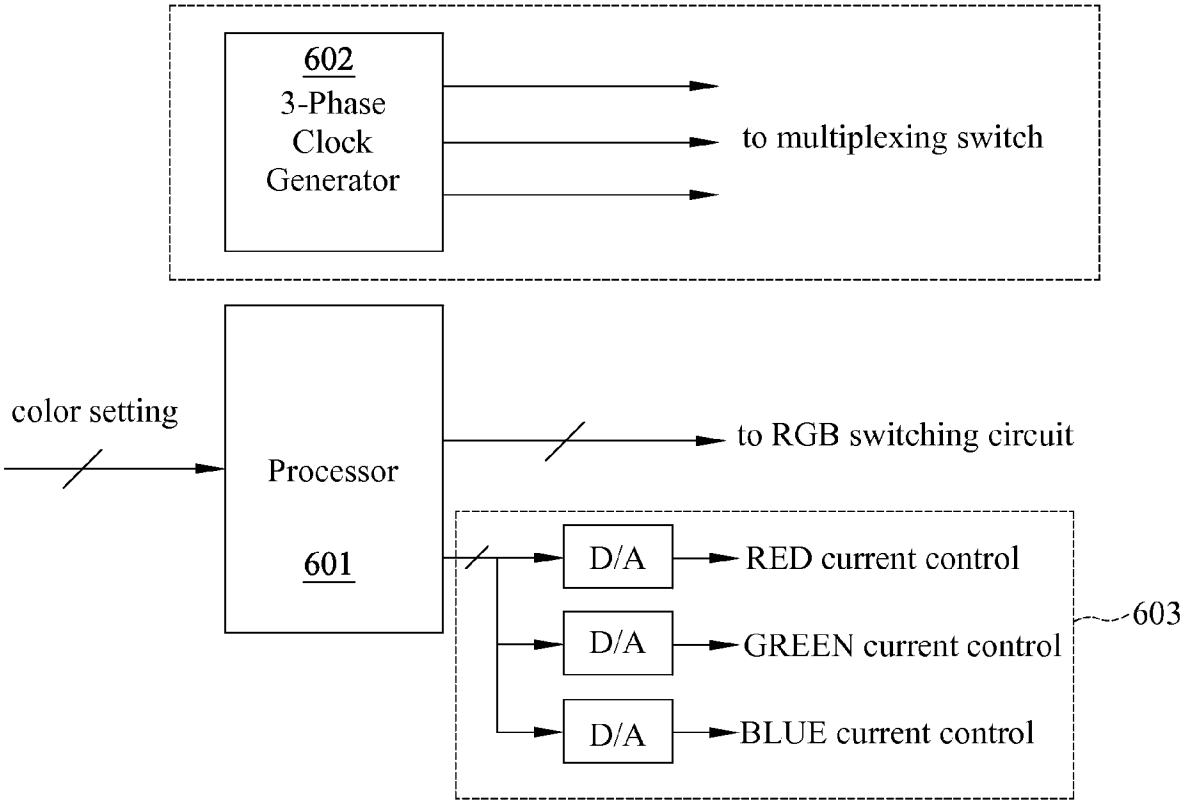
FIG. 6 shows the circuit block diagram of the controller for the first method of controlling the apparatus for driving multi-color LED strings according to the present invention.

FIG. 6 shows the circuit block diagram of the controller for the first method of controlling the apparatus for driving multi-color LED strings according to the present invention. The controller comprises a processor 601 that receives the color setting signal and sends a plurality of controlling signals to the switching circuits corresponding to the red, green and blue LED strings. If the current sources shown in the first preferred embodiment are variable current sources, a current controller 603 that includes three digital-to-analog (D/A) converters is used to respectively control the current sources connected to the red, green and blue LED strings.

As described above, in the third preferred embodiment shown in FIG. 4 of the present invention, a multiplexing switch 106 is used to connect the red, green or blue LED string 101, 102 or 103 to the common current source 133. As a result, the controller 104 for the third preferred embodiment further comprises a three phase clock generator 602 for generating multiplexing signals to control the multiplexing switch 106.

For the second method of controlling the apparatus for driving multi-color LED strings according to the present invention, the controller 104 requires some variations in the first, second and third preferred embodiments. In addition, dependent on the first, second, third or fourth exemplary type of the switching circuit, the controller 104 may have other changes.

Figure 7:
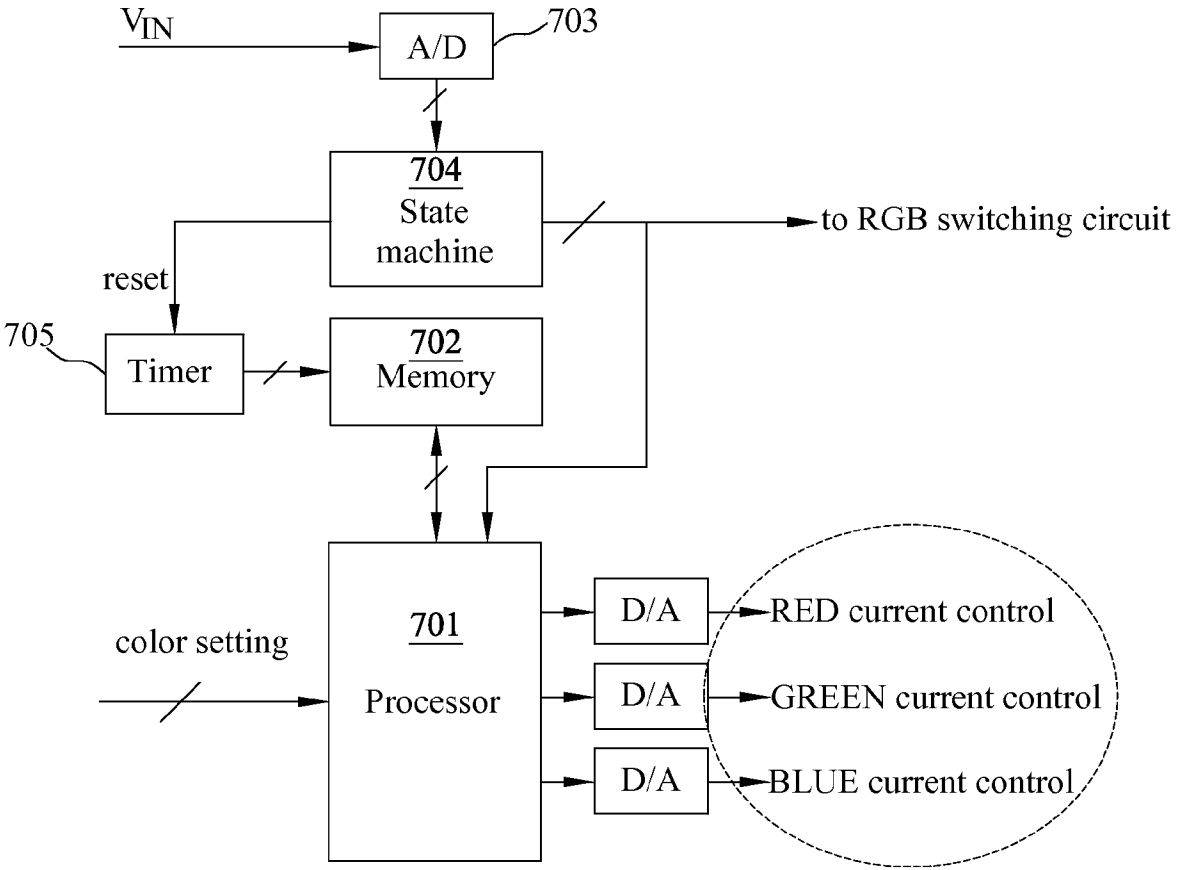
FIG. 7 shows the circuit block diagram of the controller implemented for the second method of controlling the first preferred embodiment of the apparatus with the first or third exemplary type of the switching circuit.

FIG. 7 shows the circuit block diagram of the controller 104 implemented for the second method of controlling the first preferred embodiment of the apparatus with the first or third exemplary type of the switching circuit. As can be seen in FIG. 7, the controller comprises a processor 701 that receives a color setting signal. A memory device 702 is used to store a waveform table computed by the processor 701.

An analog-to-digital (A/D) converter 703 converts the input voltage $V_{IN}$ into a digital signal that is sent to a state machine 704. The state machine 704 generates a plurality of controlling signals to the switching circuits corresponding to the red, green and blue LED strings to control the number of LEDs connected in series in each LED string according to the voltage level of the input voltage $V_{IN}$. The state machine 704 also controls a timer 705 that interfaces with the memory device 702. The processor 701 also receives the plurality of controlling signals generated by the state machine 704 and controls three D/A converters for generating current control signals to shut down the respective current sources connected to the red, green and blue LED strings at appropriate time.

Figure 8:
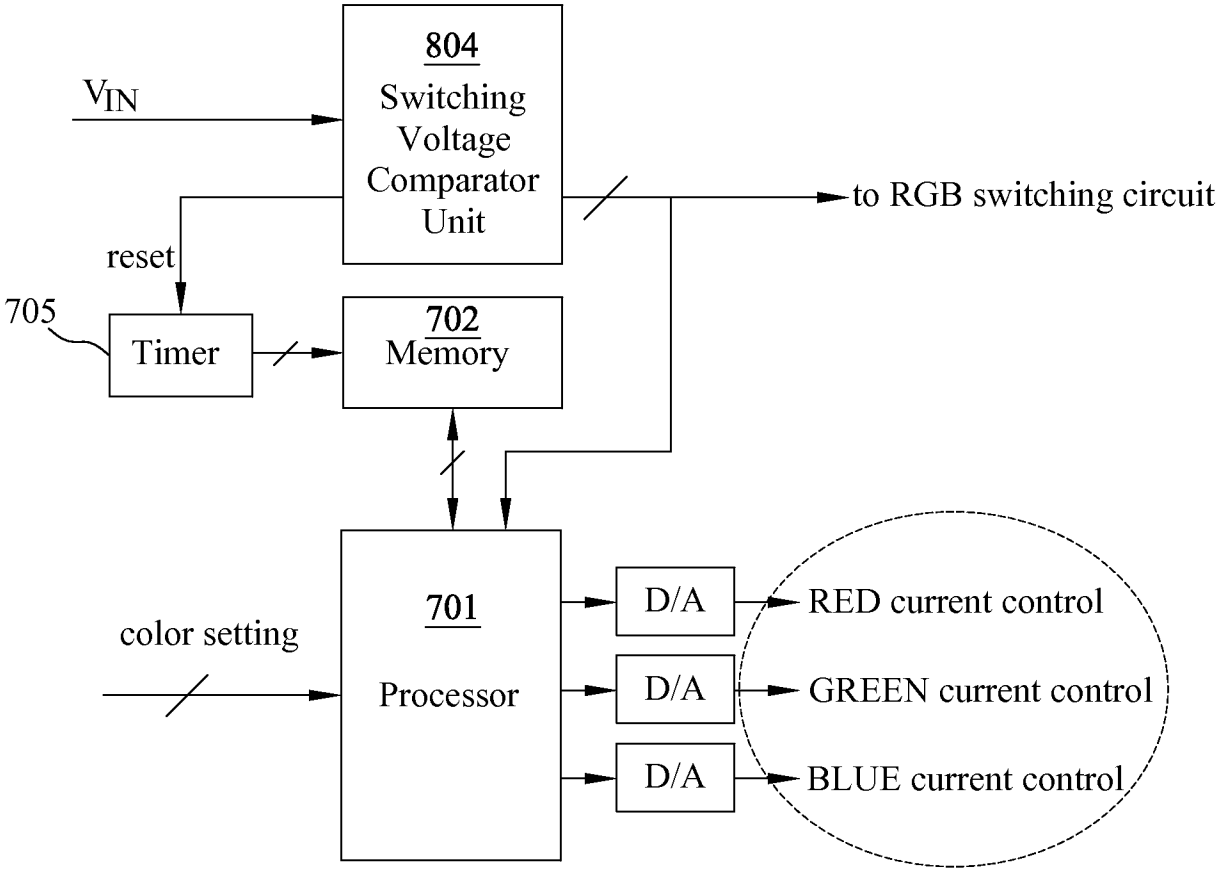
FIG. 8 shows the circuit block diagram of the controller implemented for the second method of controlling the first preferred embodiment of the apparatus with the second or fourth exemplary type of the switching circuit.

FIG. 8 shows the circuit block diagram of the controller 104 implemented for the second method of controlling the first preferred embodiment of the apparatus with the second or fourth exemplary type of the switching circuit. As can be seen in FIG. 8, the controller in this embodiment is very similar to the one shown in FIG. 7 except that the A/D converter 703 and the state machine 704 are replaced by a switching voltage comparator unit 804.

Figure 9:
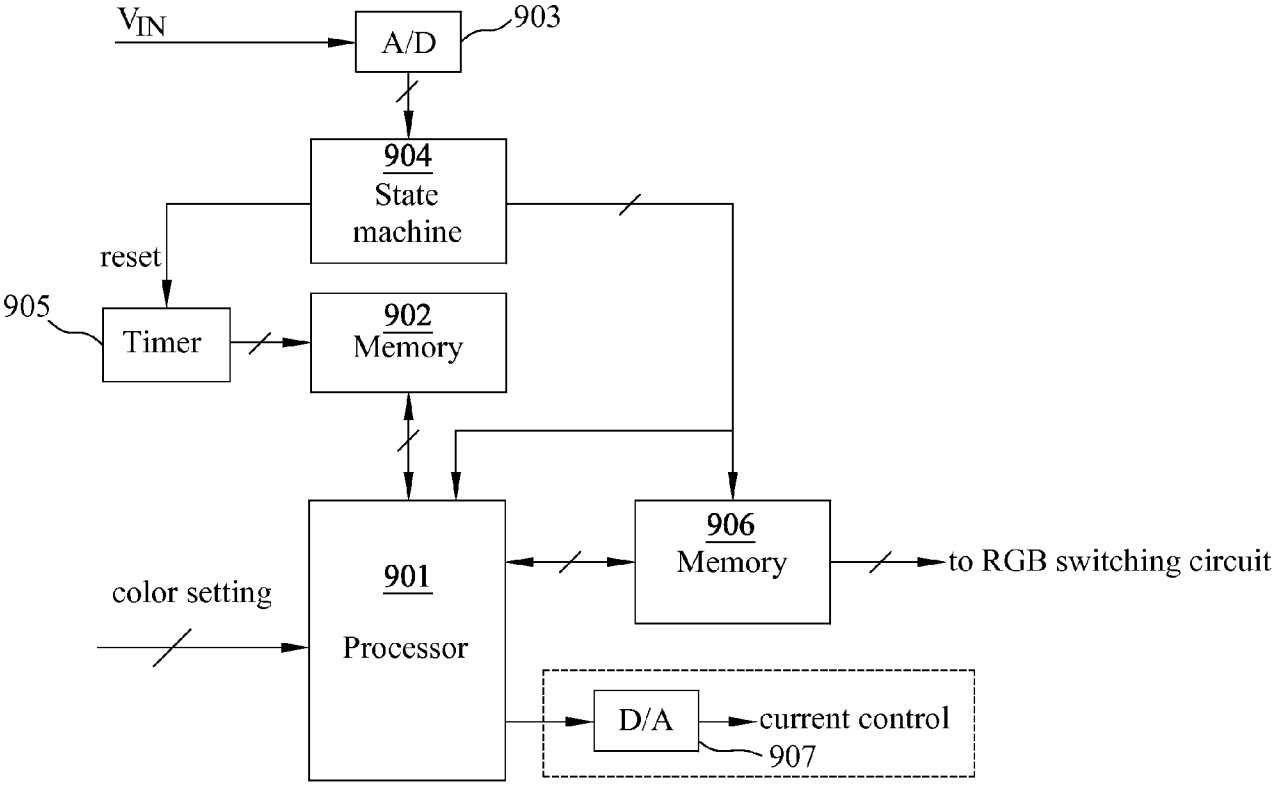
FIG. 9 shows the circuit block diagram of the controller implemented for the second method of controlling the second preferred embodiment of the apparatus with the first or third exemplary type of switching circuit.

FIG. 9 shows the circuit block diagram of the controller 104 implemented for the second method of controlling the second preferred embodiment of the apparatus with the first or third exemplary type of the switching circuit. As can be seen in FIG. 9, the controller comprises a processor 901 that receives a color setting signal. A memory device 902 is used to store a waveform table computed by the processor 901.

An analog-to-digital (A/D) converter 903 converts the input voltage $V_{IN}$ into a digital signal that is sent to a state machine 904. The state machine 904 controls a timer 905 that interfaces with the memory device 902. Another memory device 906 controlled by the state machine 904 is used to store a switching table. The processor 901 interfaces with the memory devices 906 for sending the plurality of controlling signals to the switching circuits corresponding to the red, green and blue LED strings to control the number of LEDs connected in series in each LED string according to the voltage level of the input voltage $V_{IN}$. The processor 901 may also controls a D/A converter 907 for generating a current control signal to control the current source in the second preferred embodiment of the apparatus.

Figure 10:
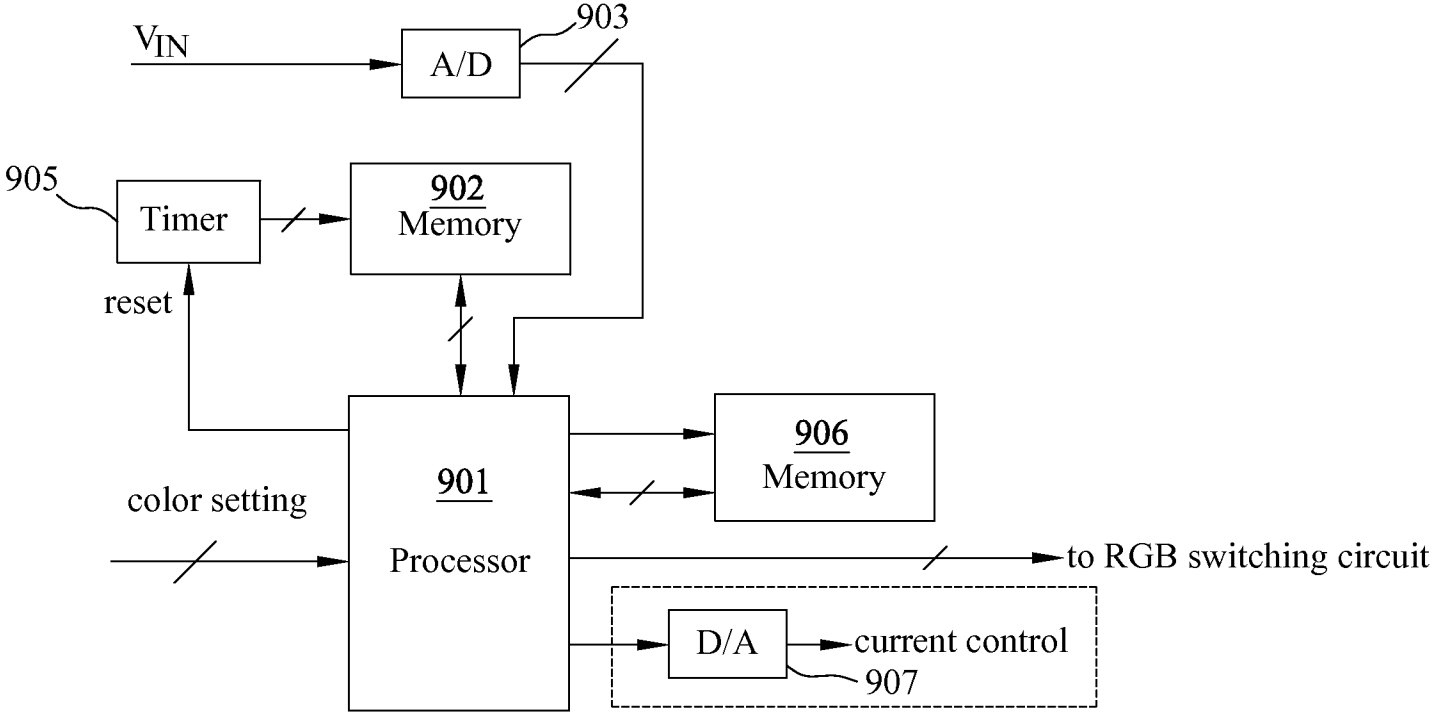
FIG. 10 shows the circuit block diagram of the controller implemented for the second method of controlling the second preferred embodiment of the apparatus with the second or fourth exemplary type of switching circuit.

FIG. 10 shows the circuit block diagram of the controller 104 implemented for the second method of controlling the second preferred embodiment of the apparatus with the second or fourth exemplary type of the switching circuit. As can be seen in FIG. 10, the controller in this embodiment is very similar to the one shown in FIG. 9 except that the state machine 904 is not used in this embodiment. The A/D converter 903 sends the digital signal to the processor 901. The plurality of controlling signals sent to the switching circuits corresponding to the red, green and blue LED strings are generated by the processor 901 instead of the memory device 906.

Figure 11:
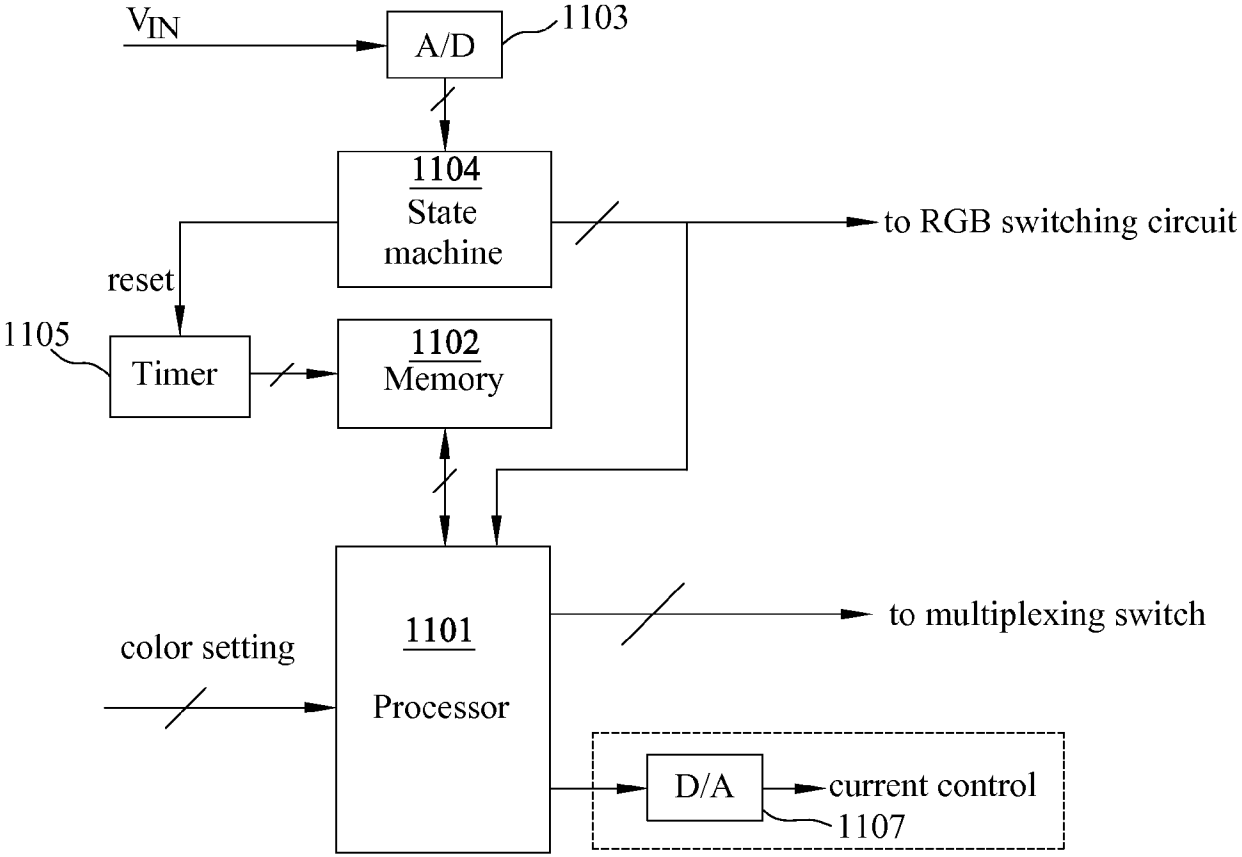
FIG. 11 shows the circuit block diagram of the controller implemented for the second method of controlling the third preferred embodiment of the apparatus with the first or third exemplary type of switching circuit.

FIG. 11 shows the circuit block diagram of the controller 104 implemented for the second method of controlling the third preferred embodiment of the apparatus with the first or third exemplary type of the switching circuit. As can be seen in FIG. 11, the controller comprises a processor 1101 that receives a color setting signal. A memory device 1102 is used to store a waveform table computed by the processor 1101.

An analog-to-digital (A/D) converter 1103 converts the input voltage $V_{IN}$ into a digital signal that is sent to a state machine 1104. The state machine 1104 generates a plurality of controlling signals to the switching circuits corresponding to the red, green and blue LED strings to control the number of LEDs connected in series in each LED string according to the voltage level of the input voltage $V_{IN}$. The state machine 1104 also controls a timer 1105 that interfaces with the memory device 1102. The processor 1101 receives the plurality of controlling signals generated by the state machine 1104 and outputs multiplexing signals to the multiplexing switch. The processor 1101 may also control a D/A converter 1007 for generating a current control signal to control the current source in the third preferred embodiment of the apparatus.

Figure 12:
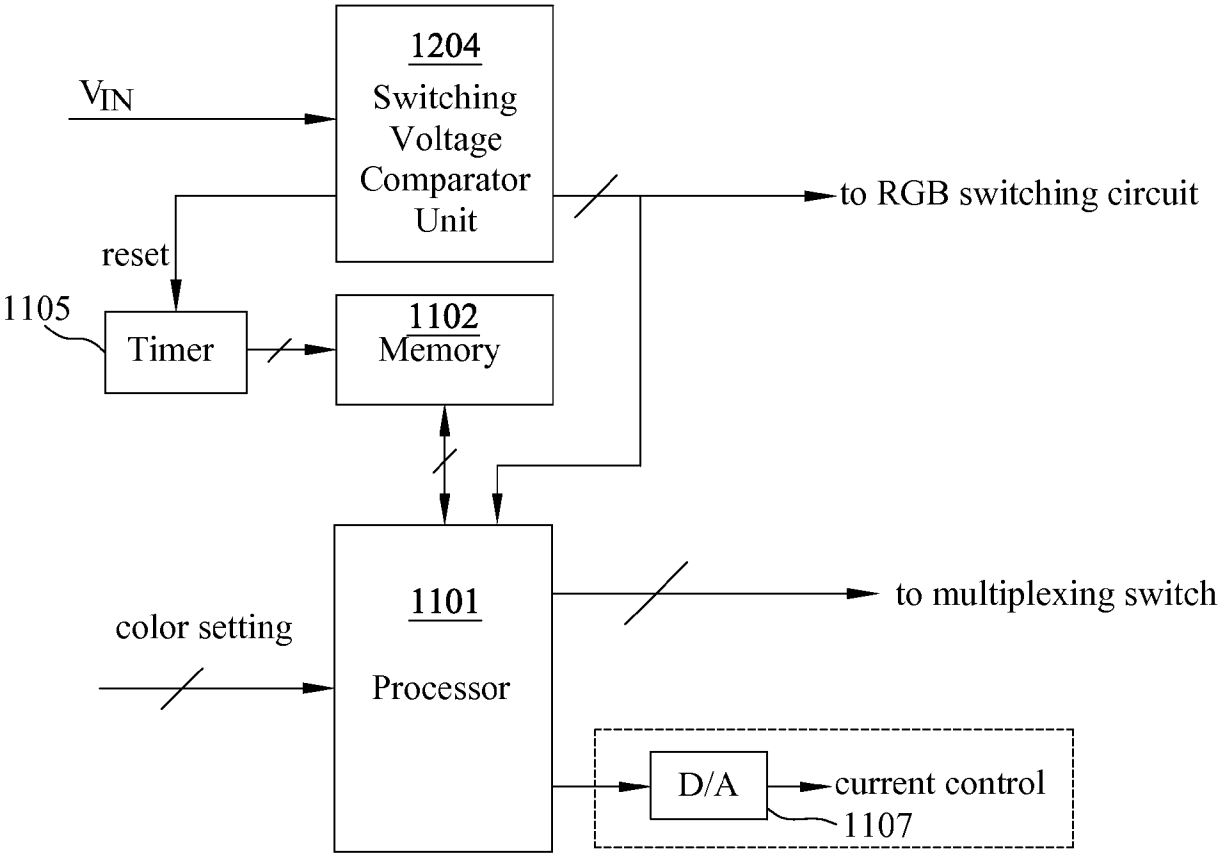
FIG. 12 shows the circuit block diagram of the controller implemented for the second method of controlling the third preferred embodiment of the apparatus with the second or fourth exemplary type of switching circuit.

FIG. 12 shows the circuit block diagram of the controller 104 implemented for the second method of controlling the third preferred embodiment of the apparatus with the second or fourth exemplary type of the switching circuit. As can be seen in FIG. 12, the controller in this embodiment is very similar to the one shown in FIG. 11 except that the A/D converter 1103 and the state machine 1104 are replaced by a switching voltage comparator unit 1204.

Figure 13:
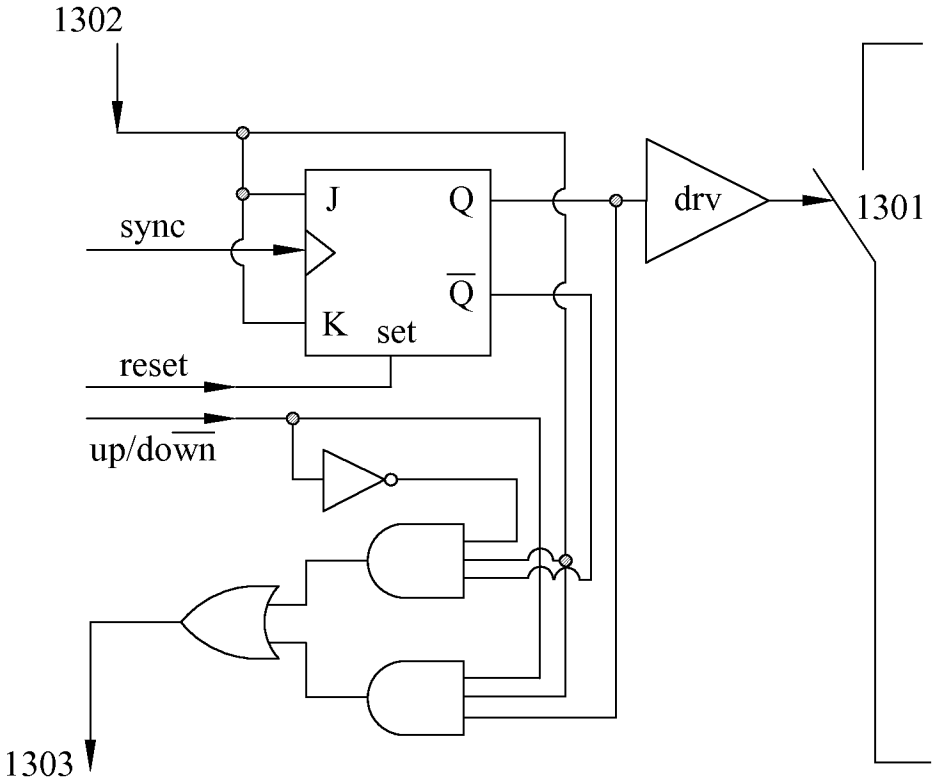
FIG. 13 shows the LED controlling circuit of the second exemplary type used for the second method for controlling the first or third preferred embodiment of the apparatus according to the present invention.

As described before and shown in FIG. 2B, the second exemplary type 261 of the switching circuit has an LED controlling circuit 262 connected in parallel with an LED segment 221. The LED controlling circuit 262 of the second exemplary type 261 used for the second method for controlling the first or third preferred embodiment of the apparatus according to the present invention is shown in FIG. 13. As can be seen in FIG. 13, the LED controlling circuit comprises a switching device 1301 for by-passing the corresponding LED segment. The LED controlling circuit receives a few common signals including reset, up/down and sync signals from the controller. The LED controlling circuit also receives an input propagation signal 1302 and sends out an output propagation signal 1303.

Figure 14:
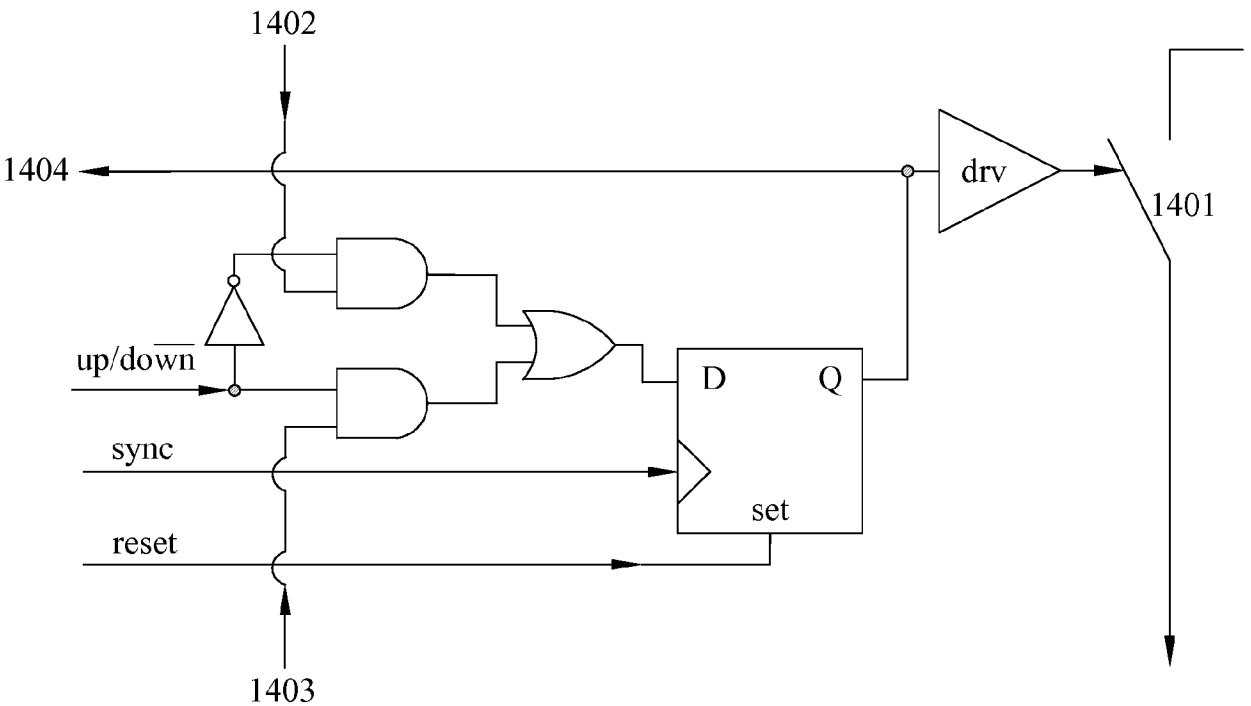
FIG. 14 shows LED controlling circuit of the fourth exemplary type used for the second method for controlling the first or third preferred embodiment of the apparatus according to the present invention.

With reference to FIG. 2D, the fourth exemplary type 281 of the switching circuit has an LED controlling circuit 282 corresponding to each LED segment 221. The LED controlling circuit 282 of the fourth exemplary type 261 used for the second method for controlling the first or third preferred embodiment of the apparatus according to the present invention is shown in FIG. 14. As can be seen in FIG. 14, the LED controlling circuit comprises a switching device 1401 for by-passing one or more LED segments. The LED controlling circuit receives a few common signals including reset, up/down and sync signals from the controller. The LED controlling circuit also receives first and second input propagation signals 1402, 1403 and sends out an output propagation signal 1404.

The exemplary circuits shown for the LED controlling circuit and the controller are given to explain the principles of the present invention. They can be designed with other equivalent circuits that can achieve the same functions. Each switching device in the above description refers generally to a switching device with appropriate controlling mechanism for opening or closing the connection of a circuit. The switching device may be mechanical or electrical, or a semiconductor switch implemented with integrated circuits.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for driving multi-color LED strings, comprising:

an input voltage;

a multiplexing switch having first, second and third inputs and an output;

a red LED string having a plurality of red LEDs controlled by a corresponding switching circuit, said red LED string having a positive end connected to said input voltage and a negative end connected to said first input of said multiplexing switch;

a green LED string having a plurality of green LEDs controlled by a corresponding switching circuit, said green LED string having a positive end connected to said input voltage and a negative end connected to said second input of said multiplexing switch;

a blue LED string having a plurality of blue LEDs controlled by a corresponding switching circuit, said blue LED string having a positive end connected to said input voltage and a negative end connected to said third input of said multiplexing switch;

a current source having a first end connected to said output of said multiplexing switch and a second end connected to ground;

a controller receiving a color setting signal and sending a plurality of controlling signals to each of the switching circuits, and multiplexing signals to control said multiplexing switch;

wherein said controller controls respective numbers of LEDs connected in series in the red, green and blue LED strings through the corresponding switching circuits, and the duration that said current source is turned on for each of the red, green and blue LED strings according to said color setting signal.

2. The apparatus as claimed in claim 1, wherein said controller comprises a processor for receiving said color setting signal and generates said plurality of controlling signals.

3. The apparatus as claimed in claim 2, wherein said controller further comprises a digital-to-analog converter controlled by said processor for generating a current control signal to said current source.

4. The apparatus as claimed in claim 1, wherein said controller further comprises a three-phase clock generator for generating said multiplexing signals to control said multiplexing switch.

5. The apparatus as claimed in claim 1, wherein each of the red, green and blue LED strings is divided into a plurality of LED segments each having at least one LED, each of the plurality of LED segments having a corresponding controlling circuit in the corresponding switching circuit.

6. The apparatus as claimed in claim 5, wherein each of the corresponding controlling circuits is a switching device.

7. The apparatus as claimed in claim 6, wherein said controller comprises:

an analog-to-digital converter for converting said input voltage to a digital signal;

a state machine receiving said digital signal and generating said plurality of controlling signals to the corresponding switching circuits;

a memory device for storing a waveform table;

a timer controlled by said state machine and interfacing with said memory device; and a processor receiving said color setting signal and said plurality of controlling signals, interfacing with said memory device, and sending multiplexing signals to said multiplexing switch.

8. The apparatus as claimed in claim 7, wherein said controller further comprises a digital-to-analog converter controlled by said processor to send a current control signal to said current source.

9. The apparatus as claimed in claim 6, wherein the corresponding controlling circuit of each of the plurality of LED segments is connected between a positive end of the corresponding LED segment and a negative end of the corresponding LED segment.

10. The apparatus as claimed in claim 6, wherein the corresponding controlling circuit of each of the plurality of LED segments is connected between a positive end of the corresponding LED segment and a negative end of a last LED segment in the respective LED string.

11. The apparatus as claimed in claim 5, wherein each of the corresponding controlling circuits comprises a switching device, receives a few common signals from said controller and at least an input propagation signal, and sends out an output propagation signal.

12. The apparatus as claimed in claim 11, wherein said controller comprises:

a switching voltage comparator unit receiving said input voltage and generating said plurality of controlling signals to the corresponding switching circuits;

a memory device for storing a waveform table;

a timer controlled by said switching voltage comparator unit and interfacing with said memory device; and a processor receiving said color setting signal, said plurality of controlling signals and interfacing with said memory device and sending multiplexing signals to said multiplexing switch.

13. The apparatus as claimed in claim 11, wherein said controller further comprises a digital-to-analog converter controlled by said processor to send a current control signal to said current source.

14. The apparatus as claimed in claim 11, wherein the corresponding controlling circuit of each of the plurality of LED segments is connected between a positive end of the corresponding LED segment and a negative end of the corresponding LED segment.

15. The apparatus as claimed in claim 11, wherein the corresponding controlling circuit of each of the plurality of LED segments is connected between a positive end of the corresponding LED segment and a negative end of a last LED segment in the respective LED string and receives two input propagation signals.

* * * * *